United States Patent [19]

Bixby

[11] 3,958,988

[45] May 25, 1976

[54] PHOTOCONDUCTORS HAVING IMPROVED SENSITIVITY BY PRESENCE OF A LIKE POLAR FIELDS DURING IMAGING

[75] Inventor: William E. Bixby, Deerfield, Ill.

[73] Assignee: A. B. Dick Company, Niles, Ill.

[22] Filed: Feb. 19, 1974

[21] Appl. No.: 443,501

[52] U.S. Cl. ..... 96/1 C; 96/1 R

[51] Int. Cl.[2] ..... G03G 13/02; G03G 15/00

[58] Field of Search ..... 96/1 R, 1.4, 1 C; 250/326; 355/3 R, 17, 16, 3 CH

[56] References Cited

UNITED STATES PATENTS

| | | | |
|---|---|---|---|
| 2,297,691 | 10/1942 | Carlson | 96/1.4 |
| 2,808,328 | 10/1957 | Jacob | 96/1.2 |
| 2,833,930 | 5/1958 | Walkup | 96/1 C |
| 3,254,998 | 6/1966 | Schwertz | 96/1 R |
| 3,262,806 | 7/1966 | Gourge | 96/1 R |
| 3,427,242 | 2/1969 | Mihajlov | 355/3 R |
| 3,680,955 | 8/1972 | Yata et al. | 96/1 R |

FOREIGN PATENTS OR APPLICATIONS

| | | | |
|---|---|---|---|
| 873,080 | 7/1961 | United Kingdom | 96/1 R |

*Primary Examiner*—David Klein
*Assistant Examiner*—L. Y. Falasco
*Attorney, Agent, or Firm*—McDougall, Hersh & Scott

[57] ABSTRACT

A method for developing a latent electrostatic image on a photoconductive surface which has previously been provided with an overall electrostatic charge of a predetermined polarity in which the charged surface is exposed to the image pattern of light and shadow for dissipation of the electrostatic charge in the light exposed areas while an electrode having an electrical potential of the same polarity as the electrostatic charge on the surface is positioned closely adjacent the charged surface.

14 Claims, 3 Drawing Figures

Figure 1:
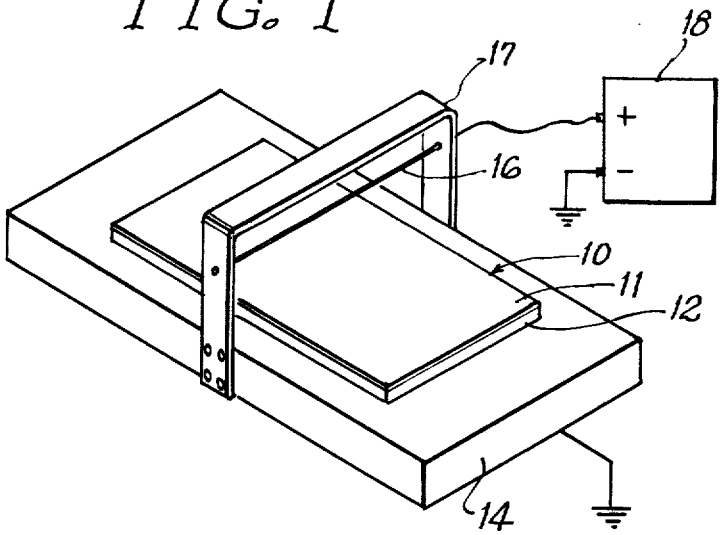

PHOTOCONDUCTORS HAVING IMPROVED SENSITIVITY BY PRESENCE OF A LIKE POLAR FIELDS DURING IMAGING

This invention relates to the art of xerography, and more particularly to the production of the latent electrostatic image by light exposure of a charged photoconductive surface.

In accordance with the conventional xerographic process for the development of copies, a uniform electrostatic charge is applied to the surface of a photoconductive insulating body, and this charge is selectively dissipated by exposure and its consequent dissipation of electric charge in the light-exposed areas results in an electrostatic latent image which can subsequently be developed or made visible by treatment with an electroscopic material which adheres to the electrostatic charged areas and which, optionally, may be transferred to a second surface to form an electrophotographic or xerographic print or copy.

For the application of the electrostatic charge or charge potential to the photoconductive insulating body, there have been proposed and tried various means, methods, and apparatus. The preferred method as described in U.S. Pat. Nos. 2,576,047, 2,666,144 and 2,836,725, employs a form of corona discharge for charging the photoconductive insulating layer, wherein an adjacent electrode comprising one or more fine conductive bodies maintained at a high electric potential causes deposition of an electrostatic charge on the adjacent surface of the photoconductive body.

In another method, a uniform electrostatic charge of the desired potential is applied to the photoconductive insulating surface by means of a plate electrode, in a manner more fully described in U.S. Pat. No. 2,833,930.

A number of problems continue to exist in the production of the latent electrostatic image upon light exposure of the charged photoconductive insulating surface. One such problem resides in the lack of sufficient sensitivity for fast reduction of the electrical potential on the photoconductor in response to a given exposure to light whereby development of the latent electrostatic image might be achieved in minimum exposure time.

Another problem has to do with the ability to reduce the potential remaining on the photoconductive insulating surface (residual potential) upon exposure, whereby the charge remaining in the light-exposed portions of the plate are reduced practically to zero for better image development with little if any background color.

Thus, it is an object of this invention to produce and to provide a method for increasing the effective sensitivity of the charged photoconductor during light exposure for development of the latent electrostatic image.

Another object is to produce and to provide a method for decreasing the residual potential in exposed portions of the charged photoconductive insulating surface during light exposure for better creation of the latent electrostatic image.

It is a related object to achieve both increased sensitivity and decreased residual potential simultaneously during light exposure for development of the latent electrostatic image of a charged photoconductive plate thereby to produce an imaged plate with less residual potential in the exposed portions, and in less exposure time.

Figure 2:
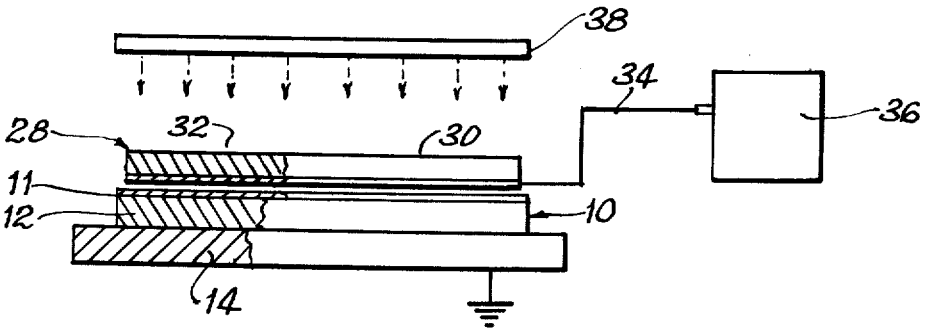
Figure 3:
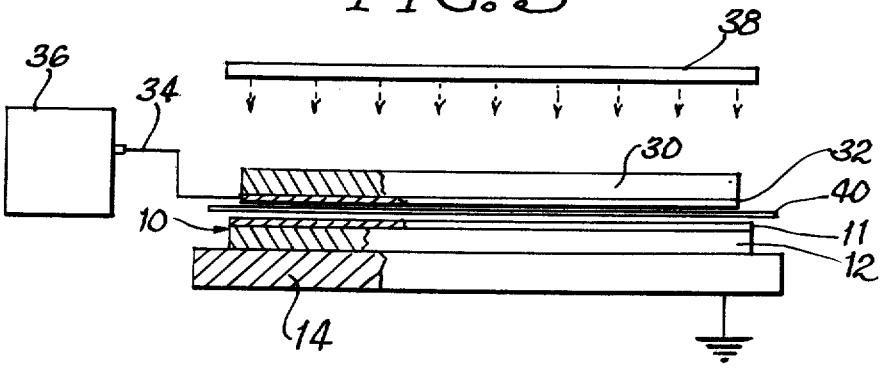

These and other objects and advantages of this invention will hereinafter be described, and, for purposes of illustration, but not of limitation, an embodiment of the invention is illustrated in the accompanying drawings, in which FIG. 1 is a perspective view of apparatus applying an overall electrostatic charge onto the photoconductive insulating surface of a plate;

FIG. 2 is a diagrammatic sectional view showing the arrangement of elements during exposure to prepare the imaged photoconductive plate in accordance with the practice of this invention; and FIG. 3 is a sectional view similar to that of FIG. 2 showing a modification thereof.

It has been found, in accordance with the practice of this invention, that the desired increased sensitivity and decreased residual potential can be achieved when a semi-transparent induction electrode, such as is formed of NESA glass, raised to high potential of the same polarity as that of the corona charge on the photoconductive surface, is positioned adjacent the charged surface during light exposure for development of the latent electrostatic image.

By way of explanation of the phenomena that gives rise to the improvements derived by the practice of this invention, two separate but simultaneous phenomena occur as a result of the light exposure of an electrostatically charged photoconductive insulating surface. When such photoconductor is exposed to light, the photons absorbed by the photoconductor in the light-exposed areas create hole-electron pairs. In the absence of an electrical field, such hole-electron pairs either recombine or are held near their point of generation in trapping sites. On the other hand, when an electrostatic field is established across the photoconductor, as by a previous corona charging operation, then when the illumination creates hole-electron pairs, they experience this field and move in a direction appropriate to this field and their polarity of charge, with the result that they appear to neutralize some of the charge that had initially been applied to the photoconductor. Obviously, at any intermediate time, a part of the initial charge has been neutralized and the field that subsequently formed hole-electron pairs experience is less than that experienced when the full field existed. If the field could be maintained more constant, at a desirable high level, during exposure, the effective speed of the photoconductor should be increased.

In accordance with the practice of this invention, when the charged photoconductive plate is exposed image-wise through semi-transparent electrode, the hole-electron pairs created will be in the field of both the corona charge on the photoconductor and that from the electrode. While the field from the corona charge decreases in the normal manner during exposure, the field from the electrode remains nearly constant and the apparent charge decay in the exposed portions will be more rapid thereby to give the effect of greater sensitivity in the photoconductor.

As illumination continues to fall on the photoconductor, the apparent voltage continues to fall toward the zero level and thereafter, upon continued exposure, it begins to rise with a polarity opposite to that initially held. Thus residual potentials for development of background color can be eliminated and even reversed to provide a latent image of one polarity and non-imaged areas of opposite polarity during development of the latent electrostatic image.

The method for image development is preferably employed and will hereinafter be described in greater detail with reference to a photoconductive plate charged by conventional corona discharge from one or more fine conductive wires or bodies at high electrical potential, as described in the aforementioned patents. It will be understood that the photoconductive insulating plate surface can be otherwise provided with an electrostatic charge of desired polarity, as described in U.S. Pat. No. 2,833,930.

Referring now to the drawings, a member to be charged, such as a xerographic plate or the like, generally designated 10, comprising a photoconductive insulating layer or body 11 overlying a conductive backing member 12 is placed on a support 14, and the conductive backing member 12 is electrically connected to ground either directly or through support member 14. A charging electrode generally designated 16, supported on a support member 17, is positioned contiguous to, or in close proximity to, the photoconductive layer 11. This charging electrode 16 comprises generally one or more discharge wires fixed in the frame 17 to extend crosswise of the plate 10 during relative linear movement between the charging wires and/or plate or both. The corona discharge wire or wires 16 are connected to a high voltage source 18.

Instead of wires, use can be made of corona discharge needles supplied with a high potential electrical current, resulting in a charge that is sprayed onto the photoconductive insulating image receiving layer 11.

By way of example, a DC voltage of 5000–8000 may be imposed on the charging wires, resulting in a uniform electrostatic charge on the plate of from 500–600 volts. The result is the formation of a charge on the surface of the plate which charge is of a potential in the order of those desired for xerography.

With reference now to the imaging of the plate in accordance with the practice of this invention, an electrode 28, in the form of a glass plate 30, preferably transparent or semi-transparent, having a conductive coating 32 (preferably transparent or semi-transparent) is spaced a few thousandths of an inch from the charged surface of the selenium coated plate 11. The conductive coating 32 is connected by line 34 to an electrical potential source 36 to provide a positive bias voltage of several hundred volts during light exposure of the charged surface to the pattern of light and shadow projected, as from an original, onto the charged surface of the plate, preferably through the electrode, while the base of the selenium coated plate is grounded.

The voltage on the surface of the plate in the exposed areas is reduced rapidly to about zero potential while the non-exposed portions retain most of the positive electrostatic charge originally present on the plate surface prior to exposure.

By way of a further experiment, continued exposure of the plate under the conditions previously described, beyond the few seconds required to reach zero potential, operated to introduce negative charge of increasing potential on the light-exposed surfaces of the plate.

Exposure in the same manner to the original, over the same period of time, but without the induction electrode, resulted in the production of an imaged plate in which the potential differential between exposed and non-exposed portions was considerably less and in which a considerable amount of residual potential remained in the exposed portions of the plate.

Development of the latent image on the surface of the selenium plate can thereafter be carried out in the conventional manner with a powder developer, followed by transfer of the powder image onto a plain paper sheet for setting the developed image thereon by heat fusion, solvent vapor, or the like. Instead, when the photoconductive coating comprises a zinc oxide coating on a paper base sheet, development of the electrostatic latent image can be achieved in the normal manner with a powder or liquid developer which can be set in the imaged areas by heat fusion or by evaporation of the solvent or in which the powder image can be transferred onto plain paper for subsequent setting to produce the desired reproduction.

The image developed in accordance with the practice of this invention, with the use of the electrode, is sharp and clear, with practically no background color in the non-imaged areas. On the other hand, the image developed without the use of the electrode, while clear, was not as sharp and background color appeared in the non-imaged areas.

The induction electrode may be formed of materials other than glass as long as it is transparent or translucent and has a conductive layer capable of taking a charge of the desired high potential. The charge should be of the same polarity as the charge on the surface of the photoconductive coating and of a voltage sufficiently high to give the desired effect, such as a voltage within the range of 100 to 1000 volts and preferably a voltage corresponding closely to the potential of the charge on the photoconductive surface.

The spacing between the induction electrode and the charged surface of the selenium or other photoconductive layer may range from a minute spacing to a spacing of 2 to 20 thousandths of an inch and preferably from 1 to 5 thousandths of an inch.

By way of modification, instead of spacing the induction electrode from the charged surface of the plate during exposure or in addition to such spacing, the induction electrode can be separated from the charged surface, during exposure, by a thin transparent or semi-transparent dielectric film 40, such as a film having a thickness of 0.0001 to 0.01 inch formed of Saran (polyvinylidine chloride), or Mylar (polyester resin).

I claim:

1. In the method of development of an electrostatic image on a photoconductive surface provided with an overall electrostatic charge of a predetermined polarity, by exposing the charged surface to an image pattern of light and shadow for dissipation of electrostatic charge in the light exposed areas, the improvement comprising positioning an electrode closely adjacent the charged surface, imposing an electrical potential on the electrode of the same polarity as that of the charge on the charged surface while the charged surface is being exposed to the image pattern of light.

2. The method as claimed in claim 1 in which the electrode is light transmittable and the exposure strikes the plate through the electrode.

3. The method as claimed in claim 1 in which the electrode is NESA glass having a layer of a highly conductive material.

4. The method as claimed in claim 1 in which the electrode is at high potential during exposure for development of the latent electrostatic image.

5. The method as claimed in claim 1 in which the potential of the electrode closely approximates the potential of the electrostatic charge on the charged surface.

6. The method as claimed in claim 1 in which exposure with the electrode is for a time to reduce the residual charge in the light exposed areas to practically zero.

7. The method as claimed in claim 1 which comprises maintaining the exposure with the electrode until the exposed areas of the surface acquire a polarity opposite the polarity in the non-exposed areas of the charged surface.

8. The method as claimed in claim 1 in which the electrical potential of the electrode during exposure is within the range of 100 to 1000 volts.

9. The method as claimed in claim 1 in which the electrode is spaced from the charged surface by an amount within the range of 2 to 20 thousandths of an inch.

10. The method as claimed in claim 1 in which a semi-transparent dielectric layer is interposed between the electrode and the charged surface during imaging.

11. The method as claimed in claim 10 in which the semi-transparent dielectric layer comprises a film which separates the electrode and the charged surface.

12. The method as claimed in claim 11 in which the film has a thickness within the range of 0.0001 to 0.01 inch.

13. The method as claimed in claim 11 in which the film is formed of a plastic selected from the group consisting of Mylar and Saran.

14. The method as claimed in claim 1 in which the photoconductive surface is provided with a uniform overall electrostatic charge prior to exposure by charging with a flat plate electrode.

* * * * *